US009267723B2

(12) United States Patent
Alfille

(10) Patent No.: US 9,267,723 B2
(45) Date of Patent: Feb. 23, 2016

(54) STORAGE DEVICE

(71) Applicant: David Anthony Alfille, Ticehurst (GB)

(72) Inventor: David Anthony Alfille, Ticehurst (GB)

( * ) Notice: Subject to any disclaimer, the term of this patent is extended or adjusted under 35 U.S.C. 154(b) by 548 days.

(21) Appl. No.: 13/668,805

(22) Filed: Nov. 5, 2012

(65) Prior Publication Data

US 2013/0061604 A1 Mar. 14, 2013

Related U.S. Application Data

(63) Continuation of application No. 11/909,370, filed as application No. PCT/GB2006/001043 on Mar. 22, 2006, now abandoned.

(51) Int. Cl.

| | |
|---|---|
| ***F25D 3/06*** | (2006.01) |
| ***F25D 3/08*** | (2006.01) |
| ***F25B 21/02*** | (2006.01) |
| ***F25B 21/04*** | (2006.01) |
| ***A47J 41/00*** | (2006.01) |
| ***B32B 9/00*** | (2006.01) |
| ***B32B 3/26*** | (2006.01) |
| ***B32B 5/20*** | (2006.01) |
| ***F25D 11/00*** | (2006.01) |

(52) U.S. Cl.

CPC ..... *F25D 11/00* (2013.01); *F25B 21/04* (2013.01); *F25B 2321/021* (2013.01); *F25B 2321/0251* (2013.01); *F25D 2331/804* (2013.01)

(58) Field of Classification Search

CPC ..... F25D 3/06; F25D 3/005; F25D 3/08; F25D 31/005; F25B 21/02; F25B 21/04; F25B 2321/02; A47J 41/00; A47J 41/077; A47J 31/50; B32B 9/00; B32B 3/26; B32B 5/20

USPC ..... 413/12, 69, 71, 72, 73, 74, 75; 220/592.09, 592.03, 592.02, 592.01, 220/592.2, 292.26

See application file for complete search history.

(56) References Cited

U.S. PATENT DOCUMENTS

| | | | | |
|---|---|---|---|---|
| 2,044,081 | A * | 6/1936 | Kjellstrom | 220/62.18 |
| 2,941,289 | A * | 6/1960 | Chace | A47J 36/02 428/677 |
| 3,725,645 | A * | 4/1973 | Shevlin | A47J 39/006 165/201 |
| 4,089,184 | A | 5/1978 | Beitner et al. | |
| 4,407,133 | A | 10/1983 | Edmonson | |
| 4,823,554 | A | 4/1989 | Trachtenberg et al. | |
| 4,955,480 | A | 9/1990 | Sexton | |
| 5,611,206 | A | 3/1997 | Sargent | |
| 5,941,077 | A * | 8/1999 | Safyan | 62/3.3 |
| 6,119,461 | A | 9/2000 | Stevick et al. | |

(Continued)

FOREIGN PATENT DOCUMENTS

| | | |
|---|---|---|
| DE | 19732193 A1 | 4/1998 |
| DE | 20305416 U1 | 10/2003 |

(Continued)

*Primary Examiner* — Frantz Jules
*Assistant Examiner* — Erik Mendoza-Wilkenfel
(74) *Attorney, Agent, or Firm* — Baker & Hostetler LLP

(57) ABSTRACT

A storage device adapted to contain a food item such a butter comprises a closeable container, a means for maintaining a predetermined temperature with the container irrespective of ambient temperature and an internal power source adapted to power the means for maintaining a predetermined temperature. The closeable container is located on a recharging unit by way of spherical feet which are received in part-spherical cups on the recharging unit.

19 Claims, 4 Drawing Sheets

(56) References Cited

U.S. PATENT DOCUMENTS

| | | | | |
|---|---|---|---|---|
| 6,279,470 | B2 | 8/2001 | Simeray et al. | |
| 6,295,820 | B1 | 10/2001 | Cauchy et al. | |
| 6,674,052 | B1 | 1/2004 | Luo | |
| 7,174,720 | B2 * | 2/2007 | Kennedy | 62/3.3 |
| 7,287,386 | B2 | 10/2007 | Upadhye et al. | |
| 2002/0092428 | A1 * | 7/2002 | Cartossi | 99/422 |
| 2004/0135041 | A1 * | 7/2004 | Tucker | 248/150 |
| 2005/0205582 | A1 * | 9/2005 | Cheng | 220/573.3 |
| 2005/0218146 | A1 * | 10/2005 | Thissen | 220/592.28 |
| 2006/0054027 | A1 * | 3/2006 | Vanthoor | 99/403 |
| 2006/0277924 | A1 * | 12/2006 | Platkin | 62/3.3 |

FOREIGN PATENT DOCUMENTS

| | | | |
|---|---|---|---|
| EP | 1374746 | A1 | 1/2004 |
| JP | 3242117 | A | 10/1991 |

* cited by examiner

STORAGE DEVICE

CROSS-REFERENCE TO RELATED APPLICATIONS

This is a continuation application of U.S. patent application Ser. No. 11/909,370 filed on Dec. 6, 2007, which is a US National Stage Entry under 35 U.S.C. §371 of PCT Application Serial No. PCT/GB2006/001043 filed on Mar. 22, 2006, which claims priority to Great Britain Patent Application No. 0506005.8, filed Mar. 23, 2005, the disclosure of each of which is hereby incorporated by reference as if set forth in its entirety herein.

BACKGROUND

This invention relates to a storage device in particular a storage device within which a predetermined temperature is maintained.

Certain solid food items which melt or soften at room temperature, for example butter, are traditionally kept in a storage area such as a refrigerator or an area of a building with a relatively low ambient temperature to maintain the food item in a substantially solid form and to prolong the storage life of the food item. When a person wished to use or serve butter, for example, the butter may be removed from the storage area and transferred to an area with a relatively higher ambient temperature. In general, time must be allowed for the butter to warm up and reach a required serving temperature to facilitate the use of the butter, for example for spreading.

A problem with placing a portion of butter in a known container on, for example, a dining surface for use during a meal is that, the butter must be allowed to soften at room temperature, the time when the butter is at an ideal serving temperature may not coincide with when the butter is actually required during the meal. If the butter is provided at the ideal serving temperature, and if the ambient room temperature is too high, the butter may not be maintained at the ideal serving temperature and may continue to soften, especially if the butter is not used immediately. In extreme cases, the butter can become liquified and unsuitable for use.

There is a need, therefore, for a storage device for food items, such as butter, which can easily and readily be transported to a location where the food item is required but which is able to maintain the food item at a predetermined temperature.

SUMMARY

It is therefore an object of the present invention to provide a storage device which overcomes or minimises these problems.

According to the present invention there is provided a storage device adapted to contain a food item comprising: a closeable container; a means for maintaining a predetermined temperature within the container irrespective of ambient temperature; and an internal power source adapted to power the means for maintaining a predetermined temperature.

The internal power source may be a rechargeable battery. The rechargeable battery may be recharged in the storage device, for example by means of a removable connection to a mains power supply. The removable connection may be in the form of a recharging unit.

Alternatively, the battery may be replaceable.

The means for maintaining a predetermined temperature within the container may comprise a heat transfer member, for example of aluminium, preferably die-cast aluminium.

The means for maintaining a predetermined temperature within the container may comprise a thermoelectric device, for example a Peltier Effect device.

The thermoelectric device may comprise a pair of opposed plates separated by a semi-conductor material.

The opposed plates may be ceramic plates.

A temperature-gradient may be produced between the opposed plates in the presence of a DC electric current.

The semi-conductor material may be bismuth telluride.

The means for maintaining a predetermined temperature effect may comprise a heat sink and/or a fan.

Electronic control means may be provided to regulate the means for maintaining a predetermined temperature.

The predetermined temperature may be in a range from substantially 10 degrees Celsius to substantially 20 degrees Celsius.

The container of the storage device may comprise an insulating layer. The insulating lay may comprise a moulded thermally insulating plastics material.

The storage device may comprise an insert within the container adapted to receive the food item. The insert may be removable from the container.

The closeable container may comprise a removable lid.

BRIEF DESCRIPTION OF THE DRAWINGS

For a better understanding of the present invention and to show more clearly how it may be carried into effect reference will now be made, by way of example, to the accompanying drawings in which.

DETAILED DESCRIPTION

Figure 1:
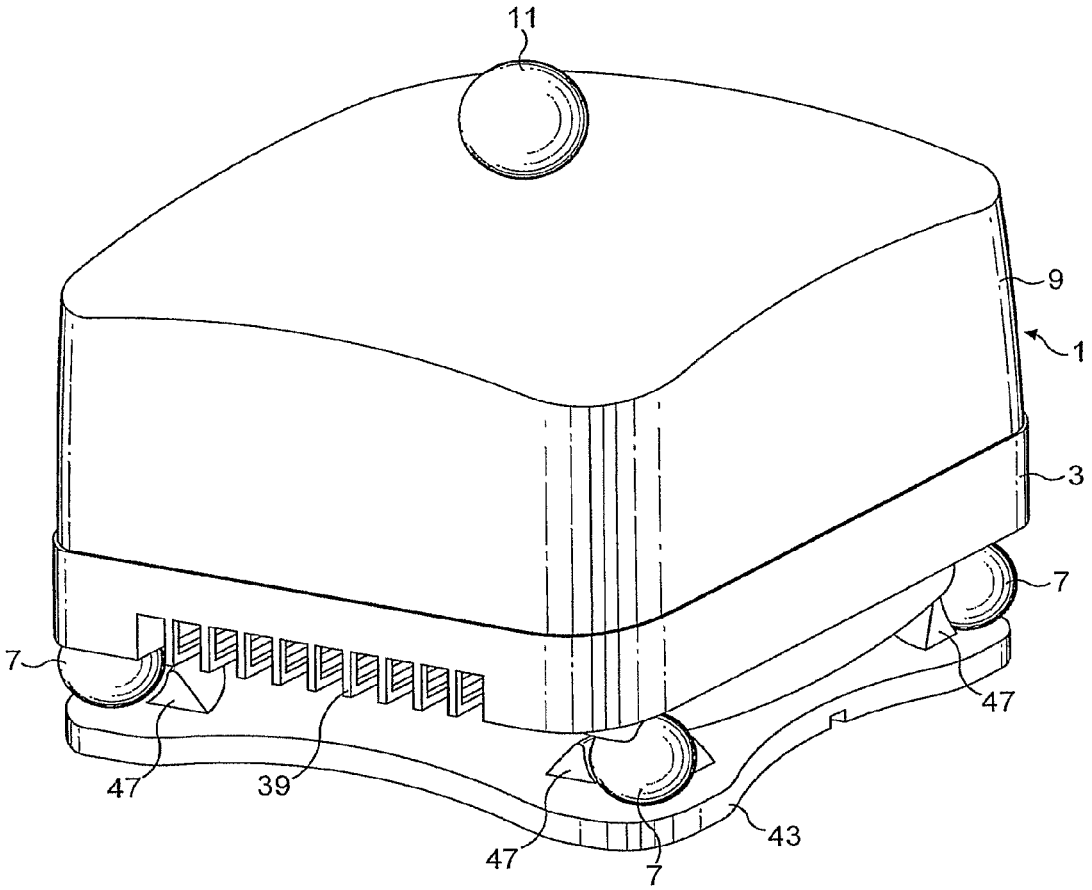
FIG. 1 is a perspective view of an embodiment of a storage device in accordance with the present invention provided with a recharging unit.
Figure 2:
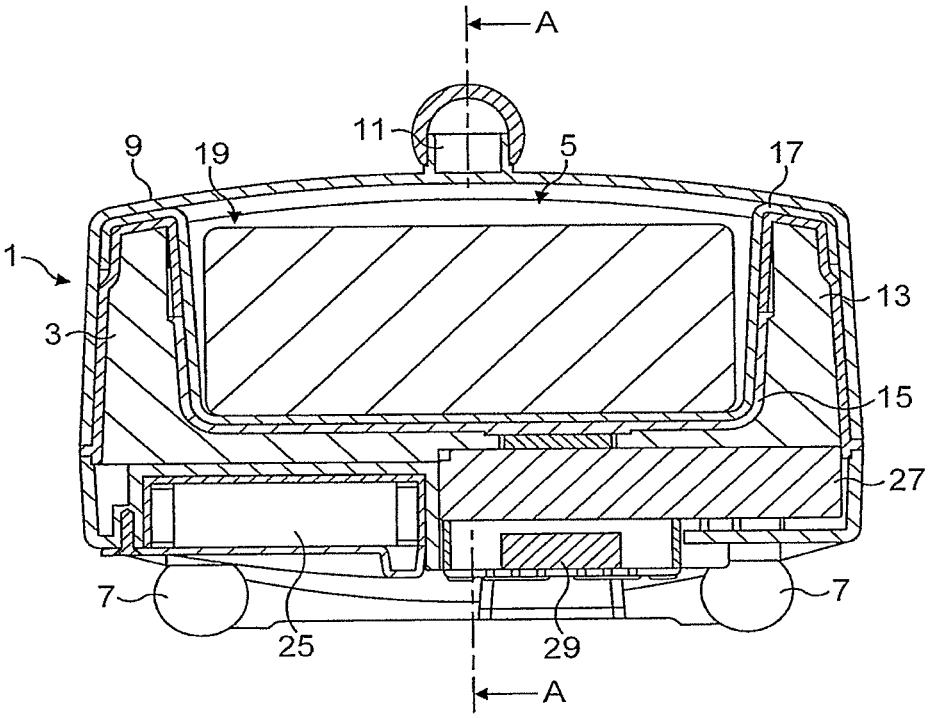
FIG. 2 is a first cross-sectional view of the storage device in FIG. 1.
Figure 3:
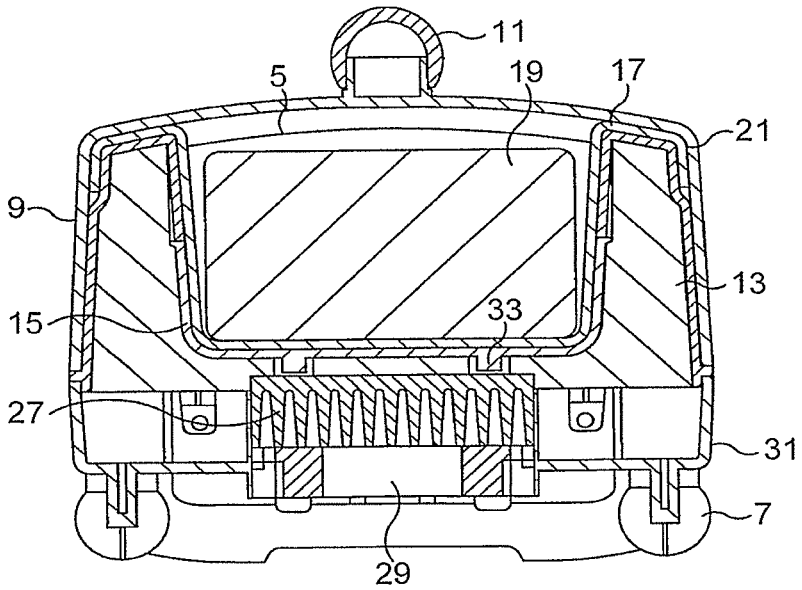
FIG. 3 is a second cross-sectional view of the storage device in FIG. 1, taken along the line A-A in FIG. 2.

Referring to FIGS. 1 to 3, the storage device 1 comprises a first container provided by a substantially rectangular box-shaped body 3 having four substantially upright walls and an opening at an upper face 5. The body is provided with a spherical foot 7 at each of the four lower corners of the body, the feet 7 being adapted to support the device on a surface. A lid 9 having a upper face and four downwardly extending walls is also provided. The lid 9 is arranged to fit over the open face 5 and externally over the four upright walls of the body to form a closeable container. A handle 11 is provided on the lid 9 to enable the lid to be removed from the body.

The body 3 and lid 9 of the storage device are made from a resilient polycarbonate plastics material. However, it should be appreciated that other resilient materials could be used. The feet 7 of the storage device are made of a rubber material, for example acrylonitrile-butadiene-styrene (BDS) rubber.

An internal upper region of the body 3 is formed with a cavity providing a first receptacle portion and having an internal bottom face and four side walls the side wall extending upwardly towards the open face of the body. The four side walls of the cavity are in the form of a substantially inverted elongate "U" such that the side walls of the cavity extend upwards the open face of the body, curve away from each other and extend downward to form portions of outer wall of the body. The shape of the side walls forms a hollow space between the outer walls of the body and the walls of the cavity. A thermal insulating block 13 is provided in this hollow space. The thermal insulating block is shaped to surround the bottom and sides of the cavity. The thermal insulating block comprises moulded expanded polystyrene but may be formed from any suitable thermal insulating material such as polyurethane foam material. A thermal insulation material may be foamed, in situ, within the hollow space between the outer walls of the body and the walls of the cavity.

A majority of the side walls forming the hollow space is of resilient polycarbonate plastics materials. However, the bottom face and lower portions of the walls of the cavity may be of aluminium, preferably die-cast aluminium, forming a dish-shaped heat transfer member 15.

Figure 4:
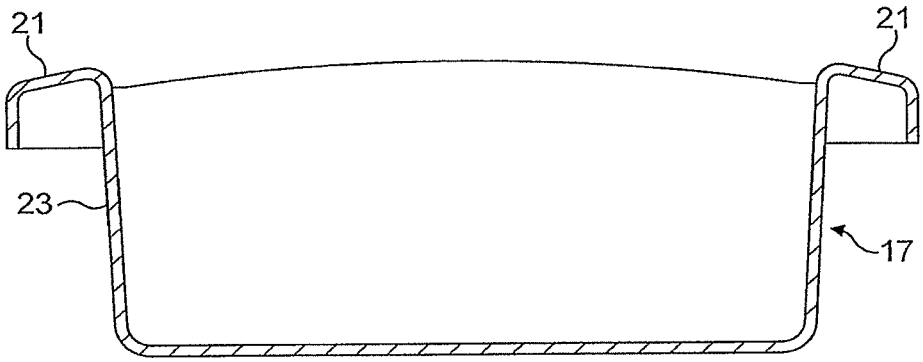
FIG. 4 is a cross-sectional view of an insert of the storage device in FIG. 1.

An insert 17 providing a second container of the device, into which a food item 19, for example butter, can be placed is provided within the cavity of the upper region of the body. The insert is dimensioned such that the outer surfaces of the insert are substantially in contact with upper regions of the side walls of the cavity with the heat transfer member 15. Upper portions 21 of the side walls 23 of the insert 17 are, as shown in FIG. 4, shaped in the form of a substantially inverted "U" to correspond to the shape of the upper surfaces of the walls of the cavity such that the side walls 23 extend over the top, and partially down the outer surface, of the upper portion of the body (as shown in FIGS. 2 and 3). The insert is manufactured from a high temperature resistant plastics material, for example a polycarbonate plastics material. The insert is removable from the cavity in the upper region of the body in order that surfaces of the insert which in use come into contact with food items can be cleaned.

Provided in a lower region of the body, beneath the insulating block 13, are an internal power source 25, in the form of a rechargeable battery pack, a heat sink 27 as known to a person skilled in the art, a fan 29 and associated electronic circuitry provided on a printed circuit board 31 (see FIGS. 2 and 3).

Figure 5:
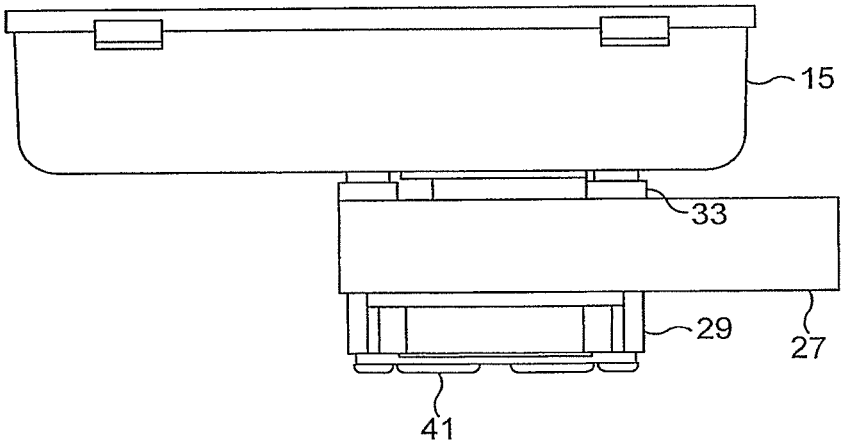
FIG. 5 is a side view of an arrangement of a heat transfer member and a heat sink of the storage device in FIG. 1.
Figure 6:
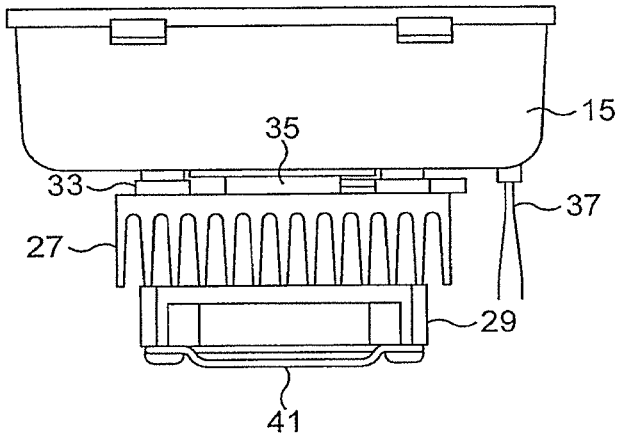
FIG. 6 is an end view of the arrangements of FIG. 5.

The relative arrangement of the heat sink 27, fan 29, and dish-shaped heat transfer member 15 is shown in FIGS. 5 and 6.

The fan 29 is positioned below the heat sink 27, adjacent to the surface of the heat sink furthest from the dish-shaped heat transfer member.

The battery pack 25 and the heat sink 27 are arranged side-by-side beneath the bottom surface of the dish-shaped heat transfer member.

As shown in FIG. 3, the heat sink 27 is provided with an undulating surface in order to increase the surface area of the heat sink from which heat can be dissipated.

A switch (not shown) is provided on the body of the storage device to enable the battery pack to be isolated from the electronic circuitry, for example when the storage device is not in use.

The heat sink 27 is separated from the bottom surface of the dish-shaped heat transfer member 15 lining the lower portion of the cavity by means of thermally and electrically insulating spacers 33 (FIG. 6). The insulating spacers pass through apertures in the lower portion of the thermal insulating block 13 positioned between the heat transfer member 15 and the heat sink 27. Positioned between the heat transfer member 15 and the heat sink 27 is a Peltier Effect thermoelectric device 35, for example a Marlow MI 1013T device.

As shown in FIG. 6, a thermistor 37 is located on the heat transfer member 15 and is the close thermal contact with the heat transfer member. The thermistor 37 is in electrical communication with temperature controlling circuitry means provided on the printed circuit board 31.

As shown in FIG. 1, the body of the device in the region of the heat sink 27 is provided with a plurality of apertures 39 to enable heat to be dissipated, for example by conduction and convection, from the heat sink 27 to the outside of the device.

The fan 29, positioned adjacent and below the heat sink 27, assists in the cooling of the heat sink. Guard means 41 is provided to prevent the insertion of items, for example fingers, into gaps between the blades of the fan.

Figure 7:
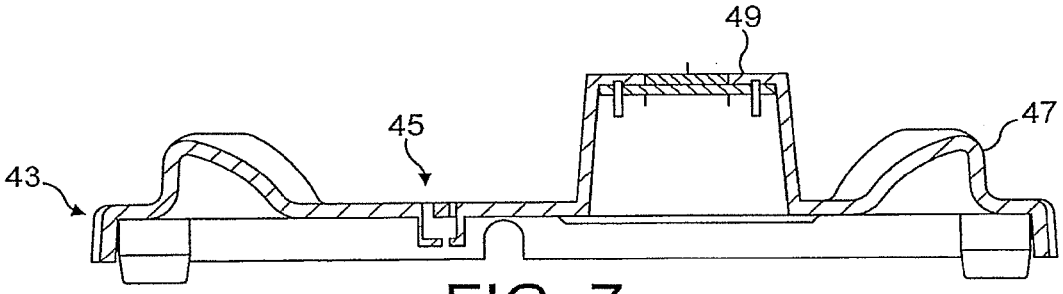
FIG. 7 is a cross-sectional view of the recharging unit in FIG. 1.

FIG. 1 shows the device positioned on a recharging unit 43, the recharging unit being in the form of a base plate. The recharging unit 43 is shown in detail in FIG. 7.

An upper surface 45 of the recharging unit 43 is shaped and dimensioned to correspond to the lower surface of the storage device 1 in order that the storage device can be easily and securely positioned on the unit 43. Cup-shaped members 47 having respective part-spherical surfaces to receive the feet 7 of the storage device are provided on the recharging unit. A male connector 49 extends upwardly from the upper surface 45 of the recharging unit and is inserted, in use, into a female connector (not shown) provided in the base of the storage device to enable an electrical connection to be made between the recharging unit and the storage device. Power supplied by a mains power supply (not shown) is used to recharge the battery pack in a manner known to a person skilled in the art.

The temperature within the cavity of the storage device is maintained at a predetermined value irrespective of the ambient temperature as described below.

A portion of butter 19 is placed in the insert 17 of the storage device and the lid 9 is placed on the body to close the device. The temperature within the device detected by the thermistor 37 will initially be substantially equal to the ambient temperature.

The resistance of the thermistor 37 equating to a predetermined temperature can be varied by means of a control potentiometer (not shown). The predetermined temperature can be adjusted within a temperature range, for example between substantially 10 to substantially 20 degrees Celsius. The predetermined temperature can be selected, for example, to equate to the ideal spreading temperature of butter. The maintenance of a constant predetermined temperature of the butter within the device can also aid in ensuring an acceptable storage life for the butter.

Detection by the electronics within the storage device of a temperature of the heat transfer member 15 in excess of the predetermined temperature, for example in excess of the 19.5 degrees Celsius, results in heat from within the cavity and the insert 17 of the storage device being removed via the thermoelectric device 35.

The thermoelectric device 35 is a solid-state component which acts as a heat pump. The thermoelectric device is in the form of two opposed plates, for example ceramic plates, separated by a semi-conductor material, for example bismuth telluride. When a DC current is applied by the internal power supply to the thermoelectric device a temperature gradient is formed between the two plates.

In the situation where there is a requirement to reduce the temperature within the cavity of the storage device, the plate nearer the cavity is configured to be the "cold face" and the plate further from the cavity, that is nearer to the heat sink is configure to be the "hot face". As heat is dissipated from the "hot face" by means of the adjacent heat sink, heat must be moved from the "cold face" to the "hot face" to maintain the aforementioned temperature gradient. Consequently, the temperature within the cavity is reduced by the action of the thermoelectric device.

Heat from the heat sink 27 is dissipated to the surrounding environment of the storage device via the apertures 39 in the body of the device.

The loss of heat from the heat sink 27 is assisted by the fan 29 which is used to cool the heat sink. Comparison means provided in the electronics determines whether the temperature detected by the thermistor 37 is above or below the predetermined temperature and controls the thermoelectric device 35 accordingly. By this means, the temperature within the storage device can be maintained at the predetermined temperature.

As it will be appreciated, if the ambient temperature is lower than the predetermined temperature, the thermistor 37 will detect an internal temperature lower than the predetermined value and the thermoelectric device will be used to increase the heat within the cavity. By mans of the electronic comparison and control means, the polarity of the DC current to the thermoelectric device 35 can be reversed, in a manner known to a person skilled in the art. As such the plate nearer the cavity is configured to be the "hot face" and the plate further from the cavity, that is nearer to the heat sink is configured to be the "cold face". As heat is dissipated from the "hot face" to heat up the cavity of the storage device, heat must be moved from the "cold face" to the "hot face" to maintain the aforementioned temperature gradient. Consequently, the temperature with the cavity is increased by the action of the thermoelectric device.

While the storage device is connected to the recharging unit 43 the predetermined internal temperature will be maintained within the storage device. However, as the storage device has its own internal power source 25, the storage device can be removed from the recharging unit 43 and transported to a location where a food item contained therein is required and the food within the device will continue to be maintained at the predetermined temperature.

When the storage device is removed from the recharging unit 43, the device is capable of maintaining the predetermined temperature, for example, for the duration of a meal, and preferably for up to 2 hours. However, batteries within the battery pack 25 will discharge during the time the storage unit is internally powered. If the storage device is not returned to the recharging unit, the batteries will continue to discharge and damage could be caused to the rechargeable batteries and/or the storage device. Consequently, a low voltage detection means (not shown) is provided which operates to prevent excessive discharge from the batteries. The low voltage detection means, as known to a person skilled in the art, will only allow the thermoelectric device 35 and fan 29 to work when the voltage provided by the batteries of the battery pack is above a predetermined value.

Although the use of a recharging unit 43 onto which a storage device in accordance with the present invention can be placed has been described as a means for recharging the batteries of the battery pack 25 of the storage device, it should be appreciated that a storage device in accordance with the present invention could be provided with batteries which are recharged by direct connection of a removable connecting lead to a mains power supply. Alternatively the storage device could be powered by replaceable batteries.

Although the insert 17 for containing food items is described as being removable from the cavity in the insulating block 13, it should be appreciated that the insert may be rigidly fixed with the device. Alternatively a storage device in accordance with the present invention may not incorporate an insert.

Although a bottom portion of the cavity in the internal region of the body has been described as being lined with a heat transfer member 15, it should be appreciated that a skin may be provided over a surface of the heat transfer member within the cavity such that food items can be placed directly in the cavity without coming into direct contact with the heat transfer member.

The body of storage device in accordance with the present invention need not be restricted to a rectangular box-shaped configuration but instead could be designed to be any shape that is required, for example for decorative or aesthetic reasons.

The outer surface of the body and/or lid of the storage device could be decorated, for example with different single colours, with patterns or other surface decorations.

What is claimed:

1. A portable storage device for maintaining the temperature of at least one food item contained in the device, the storage device comprising:

a first container including a base and at least one side wall extending upwards from the base to an upper terminal end, such that the first container at least partially defines a receptacle, wherein the base defines a heat transfer member;

a second container defining a side wall having an upper portion shaped as a substantially inverted "U" such that the upper portion of the side wall of the second container extends over the top of the upper terminal end, wherein the second container is configured to be received in the receptacle of the first container at a location adjacent the heat transfer member, the second container defining an inner surface and an opposed outer surface, wherein the outer surface of the second container is in thermal communication with the heat transfer member when the second container is disposed in the receptacle, and the inner surface defines a second receptacle that is configured to receive the at least one food item, the second container;

a heat sensor disposed adjacent the heat transfer member, the heat sensor configured to transmit a signal reflecting whether an actual temperature is above or below the desired temperature; and a thermoelectric device configured to heat or cool the base of the heat transfer member depending on whether the actual temperature is above or below the desired temperature, so as to substantially maintain the heat transfer member substantially at the desired temperature.

2. A portable storage device according to claim 1, wherein the upper portion of the side wall of the second container extends over the top of the upper terminal end and further extends down the side wall of the first container.

3. A portable storage device according to claim 2, further comprising a thermal insulating block extending between the side wall of the first container and the upper portion of the side wall of the second container.

4. A portable storage device according to claim 3, wherein the thermal insulating block further extends along a portion of the base, such that the heat transfer member is disposed between the second container and the thermal insulating block.

5. A portable storage device according to claim 4, wherein the portable storage device is devoid of thermoelectric devices that directly deliver heat to the at least one side wall.

6. The portable storage device according to claim 1, wherein the at least one side wall of the first container extends up from the base along only a portion of the height of the second receptacle.

7. The portable storage device according to claim 1, wherein the second receptacle is removable from the receptacle of the first container.

8. The portable storage device according to claim 7, including a lid capable of providing an enclosure around the first and second containers when the lid is placed on the first container and the second receptacle is placed within the receptacle of the first container.

9. The portable storage device according to claim 1, wherein the second container comprises a plastic material.

10. The portable storage device according to claim 1, wherein the first container has feet that support the first container.

11. The portable storage device according to claim 1, wherein the heat transfer member comprises aluminum material.

12. The portable storage device according to claim 1, wherein the thermoelectric device is a Peltier Effect module.

13. The portable storage device according to claim 11, wherein the thermoelectric device is a Peltier Effect module.

14. The portable storage device according to claim 1, wherein the at least one food item is a portion of butter.

15. The portable storage device according to claim 14, further comprising the portion of butter.

16. The portable storage device according to claim 1, wherein the outer surface of the second container is substantially in contact with the heat transfer member.

17. The portable storage device according to claim 1, further comprising a heat sink.

18. The portable storage device according to claim 1, further comprising a thermal insulating block disposed adjacent the heat transfer member such that the heat transfer member is disposed between the second container and the thermal insulating block.

19. The portable storage device according to claim 18, wherein the thermal insulating block extends continuously from the base to the upper portion of the at least one side wall.

* * * * *